United States Patent [19]

Edwards et al.

[11] 4,261,817

[45] Apr. 14, 1981

[54] SIEVING

[76] Inventors: Philip Edwards, The Gables, Moor La., Rowton, Chester, Cheshire, United Kingdom; Robert E. Spencer, P.O. Northrand, Transvaal, South Africa

[21] Appl. No.: 42,404

[22] Filed: May 25, 1979

[30] Foreign Application Priority Data

May 26, 1978 [GB] United Kingdom ..... 23482/78

[51] Int. Cl.[3] ..... B07B 1/28

[52] U.S. Cl. ..... 209/321; 209/357

[58] Field of Search ..... 209/245, 250, 321, 352, 209/380, 357; 73/432 PS

[56] References Cited

U.S. PATENT DOCUMENTS

| | | | |
|---|---|---|---|
| 3,719,276 | 3/1973 | Allen et al. | 209/321 X |
| 3,795,135 | 3/1974 | Anderson | 73/432 PS X |
| 3,948,764 | 4/1976 | Edwards | 209/321 X |
| 3,997,435 | 12/1976 | Farnum et al. | 209/250 X |
| 4,154,111 | 5/1979 | Anderson et al. | 73/432 PS |

FOREIGN PATENT DOCUMENTS

| | | |
|---|---|---|
| 740150 | 11/1955 | United Kingdom . |
| 782760 | 9/1957 | United Kingdom . |

*Primary Examiner*—William A. Cuchlinski, Jr.

[57] ABSTRACT

In a sieving apparatus a suction chamber is connected to a source of vacuum. The chamber is connected to sieve by a plurality of air channels. Air inlets supply air to the underside of the sieve to agitate the material being sieved. A sieve case has a cover with apertures to permit more air to enter the sieve case to further agitate the material being sieved.

16 Claims, 4 Drawing Figures

20
23
21
22
24
17
19
12
16
11
10
16
18
9
15
8
6
14
7
1
4
5
2
3

SIEVING

BACKGROUND OF THE INVENTION

The present invention relates to a method of sieving and more particularly to a method of sieving for use in determining the fineness of a granular material such as, for example, fly ash.

It is often necessary to determine the fineness of a granular material such as, for example, fly ash, and various tests have been proposed for determining the fineness of a finely divided material of this type. One such test is described in Australian Standard 1129, and another such test is described in ASTM C113. Both these standard tests measure the fineness at given points in the particle size grading by measuring the proportion of the material having particles with a diameter of greater than 150 μm and also the proportion of the material having particles with a diameter of greater than 45 μm.

By way of comparison, the British Standard method for determining the fineness involves the determination of the specific surface area, which does not directly give a measurement of particle size. The British Standard test is a difficult and laborious test to perform, and it has been found that a time of at least 45 minutes is necessary to complete the test. In this country, as an alternative to determining the specific surface area, wet sieving of fine materials has been adopted as a more reproductable test method, but a time of 25 minutes is needed to complete a wet sieving test, the duration of this period of time being mainly due to the time necessary subsequently to dry the materials before weighing. It has been proposed to utilise a rapid drying method, to reduce the time necessary to conduct this test, but it has been found that this rapid drying method eventually results in damage being done to the sieve.

It has been proposed to utilise an apparatus for sieving dry material in which a stream of air passes upwardly through the sieve into the area containing the material to be sieved thus stirring or agitating the material, a partial vacuum source subsequently drawing air and particles of small size through the sieve. Preferably proposed apparatus of this type is extremely expensive.

SUMMARY OF THE INVENTION

An apparatus for use in sieving dry material said apparatus comprising a housing defining a suction chamber, means for connecting the suction chamber to a source of vacuum, means for securing a sieve case and sieve element to the housing, means defining a plurality of air passages extending from the interior of the suction chamber to a region adjacent the sieve element when thus mounted in position and a plurality of air inlet means adapted to supply air to the said region adjacent the sieve element.

Preferably said means for connecting said suction chamber to a source of vacuum comprise a hollow spigot, and advantageously said suction chamber is provided with a pressure gauge or the like to measure the pressure within the suction chamber.

Conveniently, the suction chamber is provided with a levitation head, said levitation head comprising an element having means thereon adapted to be engaged by a portion of a sieve case, said levitation head having said air passage therein and having said air inlet means therein.

Preferably said levitation head comprises a cylindrical member having a plurality of axially extending bores and having an air inlet passage extending from the periphery thereof to one end face thereof, and conveniently said air inlet passage comprises an annular passage contained within the levitation head, radially extending passages communicating with said annular passage and a plurality of apertures connecting said annular passage and one end face of the levitation head. Advantageously said levitation head comprises a cylindrical member having a substantially centrally disposed radially outward directed flange, the member being mounted with one portion thereof inserted in an aperture in a lid or cover forming part of said housing.

Preferably said air passages are arranged in two concentric circles, and said air inlet means comprise openings between said two concentric circles.

A sieve case may be provided said sieve case comprising an element defining a chamber, and a sieve element extending across an open mouth communicating with said chamber. Preferably a cover is provided for another open mouth forming part of said sieve case, and conveniently apertures are provided in said cover.

According to another aspect of this invention there is provided a method of sieving a dry particulate material comprising the steps of introducing the material to a sieve case provided with a sieve element, drawing air through said sieve element, through a plurality of passages into a chamber that is connected to a source of partial vacuum and introducing air through a plurality of air inlet means to the side of said sieve adjacent said chamber so that air flows through the air inlet means and through the sieve element to stir or agitate the material to be sieved and subsequently flows back through the sieve into said chamber. Preferably the sieve case is provided with a cover at the end thereof remote from the sieve, and cover having apertures therein to permit a flow of air into said sieve case.

BRIEF DESCRIPTION OF DRAWINGS

In order that the invention may be more readily understood, and so that further features thereof may be appreciated, the invention will now be described by way of example with reference to the accompanying drawings in which.

DESCRIPTION OF PREFERRED EMBODIMENT

Figure 1:
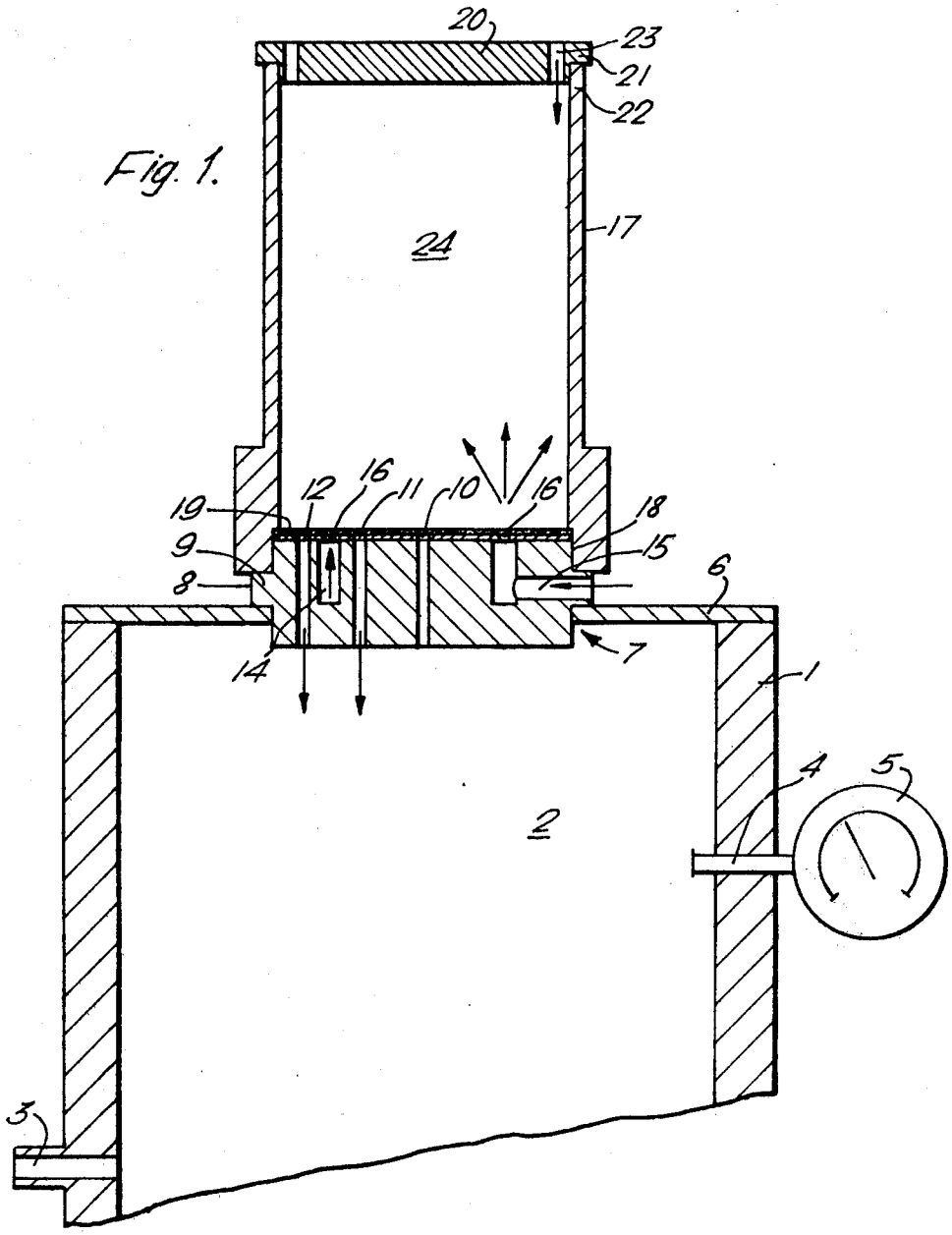
FIG. 1 is a cross sectional view through part of an apparatus in accordance with the invention.
Figure 2:
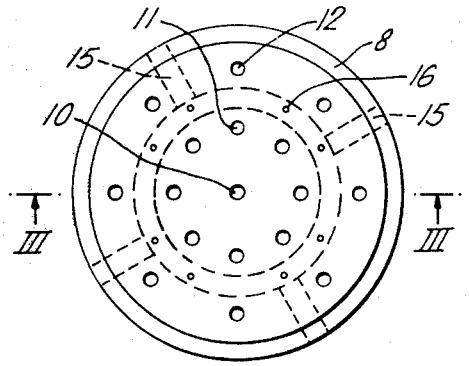
FIG. 2 is a plan view of the levitation head that forms part of the apparatus shown in FIG. 1.
Figure 3:
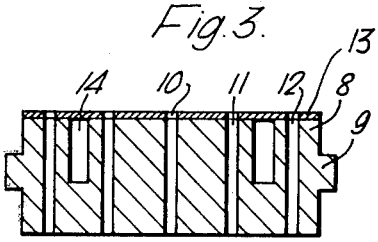
FIG. 3 is a sectional view taken on the line III—III of FIG. 2.
Figure 4:
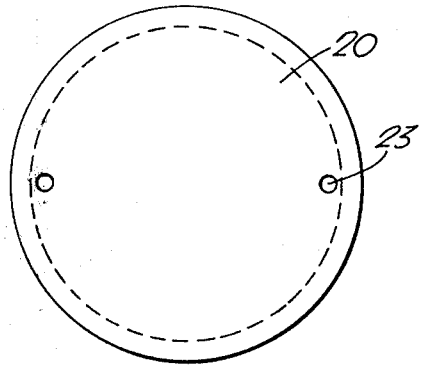
FIG. 4 is a plan view of the sieve case cover that forms part of the apparatus shown in FIG. 1.

The apparatus in accordance with the present invention comprises a hollow housing 1 which defines a suction chamber 2. The suction chamber 2 is substantially sealed but in the lower region of the housing 1 means, such as a hollow spigot 3 are provided for connecting the suction chamber 2 within the housing 1 to a hose (not shown) the hose being adapted to be connected to a source of a partial vacuum, such as a device comprising an electric motor driving an impeller such as may be found in a domestic or industrial vacuum cleaner. A filter may be provided in the hose between the suction chamber 2 and the source of partial vacuum. The suction chamber 2 is also connected, by means of an appropriate pipe or conduit 4 to a manometer or other pressure gauge 5. The pressure gauge 5 is adapted to provide an indication of the pressure within the suction chamber 2 so that the pressure within the suction chamber 2 may be monitored and adjusted.

The suction chamber is an upright cylindrical member which is closed at its base (not shown) and which is also closed at its upper end by means of an annular lid or cover 6. The annular lid or sealing element 6 defines a central round aperture 7. A levitation head 8 is mounted in position on the cover 6, the levitation head comprising a substantially circular sectioned cylindrical member having a diameter such that a portion of the member may be inserted substantially sealingly into the aperture 7. The levitation head 8 had a radially outwardly directed flange 9, the flange being located substantially mid-way between the upper surface and the lower surface of the levitation head 8. The flange has a greater diameter than the diameter of the hole 7 and thus the flange 9 rests on the cover 6. A plurality of axial bores are provided which extend through the levitation head, there being a central bore 10 having a diameter of 2 mm, eight bores 11 each having a diameter of 2 mm and being equally spaced around the periphery of a 20 mm diameter circle which has, at its centre, the centre of the bore 10, and a further eight bores 12 which are equally spaced about a 40 mm diameter circle which has, as its centre, the centre of the bore 10, the bores 11 and 12 being arranged in radially aligned pairs. The levitation head 8 includes an upper plate 13 which is mounted on, and which has the same shape and size as the upper surface of the levitation head 8. The upper plate 13 has apertures formed therein which correspond with and are coaligned with the bores 10, 11 and 12 and the arrangement is such that an air passage or communication extends between the upper surface of the plate 13 and the suction chamber 2 beneath the levitation head 8.

An annular channel 14 is formed in the upper part of the levitation head 8 the annular channel being substantially sealed off by the cover plate 13 and being located between the said circles of 20 mm diameter and 40 mm diameter having, as their centres, the bore 10. The annular channel 14 communicates with four radially extending air passages 15 which extend from the channel 14 to the periphery of the flange 8. These air passages 15 are equi-spaced around the periphery of the levitation head. At the point where each of the air passages 15 meets the annular passage 14 a 1 mm diameter hole 16 is provided in the cover plate 13, for further 1 mm diameter holes being provided at points spaced from the first four holes, all the holes 16 providing air passages between the annular passage 14 and the top of the plate 13. The holes 16 are on a 30 mm diameter circle which is centred on the bore 10.

A sieve case 17 is provided which comprises a substantially cylindrical member which is open at the upper and lower ends thereof. This sieve case 17 has an open mouth 18 at the lower end that is adapted to engage with the portion of the levitation head 8 (including the plate 13) that protrudes upwardly above the flange 9. A sieve element in the form of a sieve cloth 19 is mounted in position adjacent the open mouth of the sieve case in such a way that when the sieve case 17 is positioned on the levitation head 8 the sieve cloth 19 is immediately adjacent the upper most surface of the plate 13 or the levitation head 8. A removable cover 20 is provided for the upper open end of the sieve case 17, the cover 20 comprising a disc having an outwardly directed flange 21 of such a diameter that a portion of the disc can be inserted into the open mouth 22 defined by the top of the sieve case 17, whilst the flange engages the top of the sieve case 17. Two diametrically opposed apertures 23 are formed in the sieve case cover 20, the apertures 23 constituting an air passage between the atmosphere and the interior 24 of the sieve case 17.

In operation of the above described apparatus a weighed sample of material to be sieved is inserted into the sieve case 24 above the sieve cloth 19, and the sieve case cover 20 is located in position. The sieve case cover is located in position on the levitation head 8. Subsequently the source of partial vacuum is actuated, and it is to be understood that the source of partial vacuum may be actuated by a time switch so that the source of partial vacuum is operated for a pre-determined period of time. The pressure gauge or manometer 5 may be checked to ensure that the pressure or partial vacuum within the suction chamber is at a pre-determined level during operation of the source of partial vacuum, and a typical pressure within the suction chamber may be a negative pressure of 10 inches water gauge (25 cms water gauge).

As a result of the fall in pressure within the suction chamber 2 air flows from the interior of the sieve case 24 through the sieve cloth 19 and the bores 10, 11 and 12 into the suction chamber 2. Fine particles of the material within the sieve case that can pass through the sieve cloth are entrained with this flow of air and pass into the suction chamber 2. Consequently the pressure within the sieve case 17 falls and air flows through the radial air inlet passages 15 and the annular air passage 14 and through the apertures 16 into the sieve case 24. This flow of air into the sieve case 24 flows upwardly through the sieve cloth and serves to agitate or stir the material that is being sieved preventing any large particles from permanently blocking the most of the sieve cloth 19. Also, as a result of the reduced air pressure within the sieve case 17, air flows from the atmosphere through the apertures 23 in the sieve case cover 20, further adding to the turbulence within the sieve case 24. Thus the powdered material within the sieve case that is to be filtered is agitated by the upward air flow through the apertures 16 and by turbulence induced by the flow of air through the apertures 23. This agitation of the material being sieved prevents the filter cloth 19 from becoming clogged and consequently the powdered material within the sieve case may be rapidly sieved, with all the particles having a size less than size of the mesh of the sieve cloth passing through the sieve cloth in a short period of time. It has been found that a period of two or three minutes may be sufficient to complete the sieving of the material, the fine particles of the material having dimensions smaller than the dimensions of the opening in the sieve or mesh flowing into the suction chamber and through the hose into the filter provided in the hose (if such a filter is provided) or to the vacuum cleaner or other source of partial vacuum. The remaining particles that have dimensions greater than the apertures in the sieve or mesh remain within the sieve case.

In utilizing an apparatus in accordance with the present invention it has been found that samples of particulate material may rapidly be filtered, the results obtained being highly reproduceable. It is envisaged that an apparatus in accordance with the invention may be operated by unskilled or semi-skilled personnel and accurate results may readily be obtained. This will be of great assistance where samples of a dry particulate finely divided material have to be assessed and evaluated rapidly.

It is envisaged that the source of partial vacuum may be adapted to be operated by 240 volt AC mains electricity, 110 volt AC or DC mains electricity or 12 volt DC electricity, an appropriate converter being provided to enable the single source of vacuum to be operated by any of the specified supplies of electricity. Thus an apparatus in accordance with the invention may be operated at any convenient location, and if a source of mains electricity is not available the apparatus may be operated from a battery such a vehicle battery.

Whilst the apparatus has been described with reference to one particular embodiment that is intended to be a portable apparatus for filtering rapidly small samples of powdered materials, it is to be noted that sieves in accordance with the present invention may be utilised not only to sieve dry powdered materials on a small scale, such as laboratory specimens, but an apparatus in accordance with the invention may be used for the continuous separation of bulk materials on a commercial scale.

Again whilst the invention has been described with reference to one particular embodiment it is to be appreciated that many modifications may be made to the levitation head to alter the precise action of the air jets and such modifications may be necessary or desirable when particular specific materials are to be sieved. A number of interchangeable levitation heads may be provided for use with a single apparatus, an appropriate head being selected in dependence upon properties of the material to be sieved.

The sieve case itself may be formed to have a smaller volume within it than the volume shown in the accompanying drawings.

We claim:

1. An apparatus for use in sieving dry material, said apparatus comprising a housing defining a suction chamber, means for connecting the suction chamber to a source of vacuum, means for securing a sieve case and sieve element to the housing, a member fixedly mounted in position between said sieve element and said suction chamber, said member including a plurality of air passages extending from the interior of the suction chamber to a region adjacent the sieve element when thus mounted in position, and said member further including a plurality of air inlet means to supply air to the said region adjacent the sieve element.

2. An apparatus according to claim 1, wherein said means for connecting said suction chamber to a source of vacuum comprise a hollow spigot.

3. An apparatus according to claim 1 wherein, said suction chamber is provided with a pressure gauge to measure the pressure within the suction chamber.

4. An apparatus according to claim 1, wherein said air passages are arranged in two concentric circles, and said air inlet means comprise openings between said two concentric circles.

5. An apparatus according to claim 1 in combination with a sieve case, said sieve case comprising an element defining a chamber, and a sieve element extending across an open mouth communicating with said chamber.

6. An apparatus according to claim 5, wherein a cover is provided for another open mouth forming part of said sieve case.

7. An apparatus according to claim 6, wherein apertures are provided in said cover.

8. An apparatus for use in sieving dry material, said apparatus comprising a housing defining a suction chamber, means for connecting the suction chamber to a source of vacuum, a sieve case and a sieve element, means for connecting the sieve case and the sieve element to the housing so that the sieve element is adjacent the housing with one side of said sieve element facing towards said suction chamber, a member disposed adjacent to said one side sieve element, said member including a plurality of air passages extending from said one side of the sieve element into the suction chamber, and a plurality of air inlet means to supply air to said one side of the sieve element adjacent the housing.

9. An apparatus according to claim 8, wherein the air passages are arranged in two concentric circles and the air inlet means comprise apertures between said circles.

10. An apparatus according to claim 8, wherein said sieve case has a cover, the cover having apertures therein to permit the flow of air through the apertures into the sieve case.

11. A method of sieving a dry particulate material comprising the steps of introducing the material to a sieve case provided with a sieve element, drawing air through said sieve element, through a plurality of passages defined in a fixedly mounted member into a chamber that is connected to a source of partial vacuum, and introducing air through a plurality of air inlet means defined in the fixedly mounted member to the side of said sieve element adjacent said chamber so that the air flows through the air inlet means and through the sieve element to stir or agitate the material to be sieved and subsequently flows back through the sieve element and through the passages into said chamber.

12. A method according to claim 11, wherein the sieve case is provided with a cover at the end thereof remote from the sieve, said cover having apertures therein to permit a flow of air into said sieve case.

13. An apparatus for use in sieving dry material, said apparatus comprising a housing defining a suction chamber, means for connecting the suction chamber to a source of vacuum, means for securing a sieve case and sieve element to the housing, means defining a plurality of air passages extending from the interior of the suction chamber to a region adjacent the sieve element when thus mounted in position, a plurality of air inlet means adapted to supply air to the said region adjacent the sieve element, the suction chamber being provided with a levitation head, said levitation head comprising an element having means thereon adapted to be engaged by a portion of a sieve case, said levitation head having said air passages therein and having said air inlet means therein.

14. An apparatus according to claim 13 wherein said levitation head comprises a cylindrical member having a plurality of axially extending bores and having an air inlet passage extending from the periphery thereof to one end face thereof.

15. An apparatus according to claim 14, wherein said air inlet passage comprises an annular passage contained within the levitation head, radially extending passages communicating with said annular passage and a plurality of apertures connecting said annular passage and one end face of the levitaton head.

16. An apparatus according to claim 9, wherein said levitation head comprises a cylindrical member having a substantially centrally disposed radially outwardly directed flange, the member being mounted with one portion thereof inserted in an aperture in a cover forming part of said housing.

* * * * *